US005877479A

United States Patent [19]

Yu

[11] Patent Number: 5,877,479

[45] Date of Patent: Mar. 2, 1999

[54] MICROWAVE OVEN WITH A TURNTABLE AND MODE STIRRERS

[75] Inventor: Hak-Seok Yu, Incheon, Rep. of Korea

[73] Assignee: Daewoo Electronics Co., Ltd., Rep. of Korea

[21] Appl. No.: 995,756

[22] Filed: Dec. 22, 1997

[30] Foreign Application Priority Data

Dec. 27, 1996 [KR] Rep. of Korea ..... 1996-73448

[51] Int. Cl.[6] ..... H05B 6/74; H05B 6/78

[52] U.S. Cl. ..... 219/754; 219/751

[58] Field of Search ..... 219/754, 753, 219/752, 755, 751, 746, 748, 756, 762

[56] References Cited

U.S. PATENT DOCUMENTS

| | | | |
|---|---|---|---|
| 3,431,381 | 3/1969 | Anderson | 219/751 |
| 3,742,177 | 6/1973 | Wikstrom et al. | 219/751 |
| 4,121,078 | 10/1978 | Takano et al. | 219/754 |
| 4,249,058 | 2/1981 | Lentz et al. | 219/751 |
| 4,636,605 | 1/1987 | Berend et al. | 219/754 |
| 4,714,813 | 12/1987 | Trenchard | 219/753 |
| 5,672,291 | 9/1997 | Han | 219/753 |

FOREIGN PATENT DOCUMENTS

| | | | |
|---|---|---|---|
| 0 474 306 | 9/1991 | European Pat. Off. | 219/754 |
| 63-172827 | 7/1988 | Japan | 219/751 |
| 63-231118 | 9/1988 | Japan | 219/751 |

*Primary Examiner*—Philip H. Leung
*Attorney, Agent, or Firm*—Pillsbury, Madison & Sutro, LLP

[57] ABSTRACT

A microwave oven equipped with a microwave stirrer. The oven has a magnetron for generating a microwave, a tray for rotating a foodstuff, a stirrer for uniformly dispersing the microwave into a chamber, and a driving device for simultaneously driving the tray and the stirrer. As a driving device, a motor and a gear section are provided so that the driving device drives both the tray having rollers and stirring plates for stirring the microwave. The oven stirs the microwave so that the microwave is uniformly dispersed in a chamber, thereby uniformly heating the foodstuff.

9 Claims, 4 Drawing Sheets

MICROWAVE OVEN WITH A TURNTABLE AND MODE STIRRERS

BACKGROUND OF THE INVENTION

1. Field of the Invention

The present invention relates to a microwave oven, and more particularly to a microwave oven equipped with a microwave stirrer.

2. Description of the Prior Art

Generally, a microwave oven is a device for heating a foodstuff by radiating a microwave to a foodstuff. The microwave is generated by a magnetron. The magnetron generates a microwave having a frequency of about 2,450 MHz. When the microwave is radiated to the foodstuff placed in the microwave oven, the microwave stimulates molecules which constitute the foodstuff so that the molecules are rapidly vibrated, thereby generating a molecular frictional heat within the foodstuff. The microwave heats the foodstuff by using this frictional heat.

Generally, the microwave is generated by applying a high voltage to the magnetron. The high voltage is generated by a mutual induction between a first and second coils of a transformer installed at an inner bottom wall of a cabinet. By an antenna, the microwave is radiated into a chamber formed in the microwave oven.

FIG. 1 shows a conventional microwave oven 100. Microwave oven 100 comprises a cabinet 110 having an opening 105 at one side wall thereof. A door 150 is hinged at an edge portion of opening 105. Cabinet 110 is formed at an inner space thereof with a chamber 120 for receiving a foodstuff to be heated. A dish plate 140 for receiving a foodstuff thereon is mounted at a lower portion of chamber 120. Cabinet 110 is provided at an outer front surface thereof with a control panel 130 so as to adjust operating parameters such as a heating time according to a user's will.

Cabinet 11 is provided at one side wall thereof with a magnetron(not shown) for generating a microwave. An antenna(not shown) is provided at one edge portion of the magnetron, and radiates a microwave generated from the magnetron into the foodstuff in order to heat the foodstuff through a deep portion of the foodstuff.

FIG. 2 shows an inner structure of the conventional microwave oven 100. A separate space 615 is formed beneath chamber 120. A motor 630 is mounted at a lower portion of space 615. Motor 630 has a rotating shaft 635 upwardly extending to the lower portion of chamber 120 such that a rotating tray 650, which rotates above a bottom wall of chamber 120, is fixedly coupled to a free end of rotating shaft 635 by coupling 640. Consequently, when motor 630 is actuated, rotating tray 650 rotates together with rotating shaft 635. Rotating tray 650 supports dish plate 140 thereon. When dish plate 140 needs to be cleaned, dish plate 140 can be separated from rotating tray 650. For the stable rotation of rotating tray 650, a plurality of rollers 660 are mounted at a bottom wall of a circumferential portion of rotating tray 650 and are slidably supported on the bottom wall of chamber 120, thereby assisting rotating tray 650 to stably rotate.

As described above, microwave oven 100 is operated by actuating the magnetron and motor 630 in a state where a foodstuff is placed on a top surface of dish plate 140. By actuating motor 630, rotating shaft 635 begins rotation and consequently, dish plate 140 rotates together with rotating tray 650. The microwave generated by the magnetron is radiated to the foodstuff, thereby heating the foodstuff.

However, in the conventional microwave oven 100, the microwave cannot be sufficiently reflected and dispersed in chamber 120 so that a dead zone, where the effect of the microwave is relatively weak, is formed in chamber 120, and as a result, the foodstuff is only partly heated. The above disadvantage is partly compensated by the rotation of dish plate 140, but it is not sufficiently solved.

SUMMARY OF THE INVENTION

The present invention is intended to overcome the above described disadvantage. Therefore, it is an object of the present invention to provide a microwave oven equipped with a microwave stirrer which can disperse a microwave.

In order to achieve the above object of the present invention, there is provided a microwave oven having a microwave stirrer comprising:

a wall section forming a chamber therein for receiving a foodstuff;

a first means for generating and radiating a microwave into the chamber, the first means being located at a predetermined position of the wall section;

a second means for rotatably supporting the foodstuff thereon, the second means being installed at a lower portion of the chamber;

a third means for stirring the radiated microwave and uniformly distributing the microwave in the chamber, the third means being installed beneath the second means; and a fourth means for simultaneously driving both the second and third means.

The first means comprises a magnetron for generating a microwave and an antenna for emitting the microwave into the chamber. The antenna is provided at an edge portion of the magnetron. The second means comprises a tray, a plurality of rollers for allowing the tray to stably rotate, which are mounted at a bottom surface of a circumference of the tray, and a dish plate supporting the foodstuff thereon, the dish plate being placed on a top surface of the tray. The third means comprises a plurality of first gears, shafts which are integrally formed at respective center positions of the first gears and which extend vertically through the first gears, fans fixedly inserted around respective predetermined positions of the shafts, and stirring plates formed from a microwave-reflective material and mounted on the fans. The fourth means comprises a motor mounted at a bottom wall of the wall section, a rotating shaft upwardly extending from the motor, and a second gear fixedly inserted around a predetermined position of the rotating shaft. A free end of the rotating shaft is fixedly assembled with the tray by means of coupling and the second gear is engaged with the first gears.

According to a preferred embodiment of the present invention, there are two first gears, the stirring plates are made from aluminum, and each of the stirring plates is formed as a fan-shaped plate having six wings.

According to the preferred embodiment of the present invention, there are three rollers which are angularly spaced apart from the each other by an angle of 120 degrees.

According to the preferred embodiment of the present invention, the third means is installed within a recess formed at a bottom wall of the chamber, and a microwave-permeable protective screen is mounted on an upper edge portion of the recess, the screen is formed at a center portion thereof with a hole which is positioned in correspondence to a position of the rotating shaft, thereby permitting the rotating shaft to pierce therethrough.

The shafts are rotatably supported at the screen and a bottom wall of the recess.

According to the preferred embodiment of the present invention, the first gears have a size smaller than that of the second gear so as to have a larger RPM(revolution per minutes) than that of the second gear.

In the microwave oven according to the present invention, the rotating shaft rotates as the motor is actuated. Subsequently, the first gears are rotated together with the second gear assembled to the rotating shaft so that the wings mounted to the first gears stir the microwave radiated from the magnetron, thereby uniformly distributing a microwave energy into the chamber. At the same time, the rotating tray rotates so that the foodstuff placed on the dish plate is rotated, thereby uniformly heating the foodstuff.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a microwave oven equipped with a microwave stirrer according to a preferred embodiment of the present invention will be explained in more detail with reference to the accompanying drawings.

Figure 4:
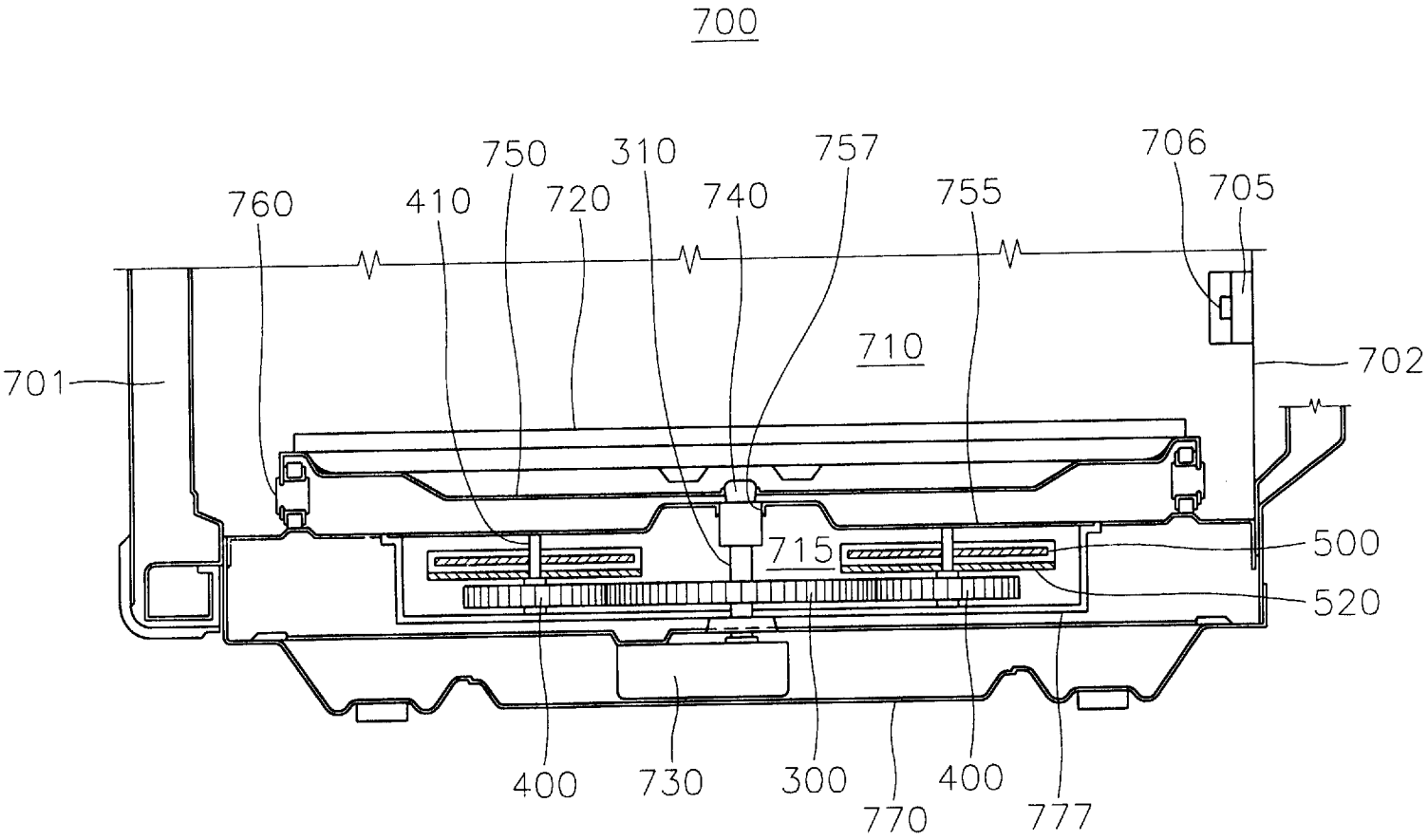
FIG. 4 is a cross-sectional view showing an inner structure of a microwave oven according to the present invention.

FIG. 4 shows a microwave oven 700 according to the present invention. Microwave oven 700 comprises a wall section 702 forming a chamber 710 therein for receiving a foodstuff. Wall section 702 has a shape of a box with one side wall thereof formed with an opening. A door 701 is hinged at an edge portion of the opening. Wall section 702 is provided at a predetermined position thereof with a magnetron 705 for generating a microwave. Magnetron 705 is provided at one edge portion thereof with an antenna 706 in order to radiate the microwave into chamber 710. A tray 750 for rotating of the foodstuff to be heated is provided at a lower portion of chamber 710. A plurality of rollers 760 are mounted at a bottom surface of a circumference of tray 750 and are slidably supported on a bottom wall of chamber 710 so that tray 750 is stably rotated. A dish plate 720 for supporting the foodstuff thereon is placed on a top surface of tray 750.

Preferably, rollers 760 are three rollers which are angularly spaced apart from the each other by an angle of 120 degrees.

As an actuating means, a motor 730 is mounted at a bottom wall of wall section 702, and has a rotating shaft 310 upwardly extending therefrom which rotates as motor 730 is actuated. A free end of rotating shaft 310 is fixedly coupled to tray 750 by means of a coupling 740 so as to rotate tray 750 as motor 730 is actuated.

Chamber 710 is formed at a bottom wall thereof with a recess 715. A microwave-permeable protective screen 755 is mounted on an upper edge portion of recess 715 and is formed at a center portion thereof with a hole 757 which is positioned in correspondence to a position of rotating shaft 310, thereby permitting rotating shaft 310 to pierce therethrough so as to be assembled with tray 750.

The microwave radiated into recess 715 passes through screen 755 and is stirred by a microwave stirrer 200 installed inside of recess 715 so that the microwave is uniformly dispersed into chamber 710.

Figure 1:
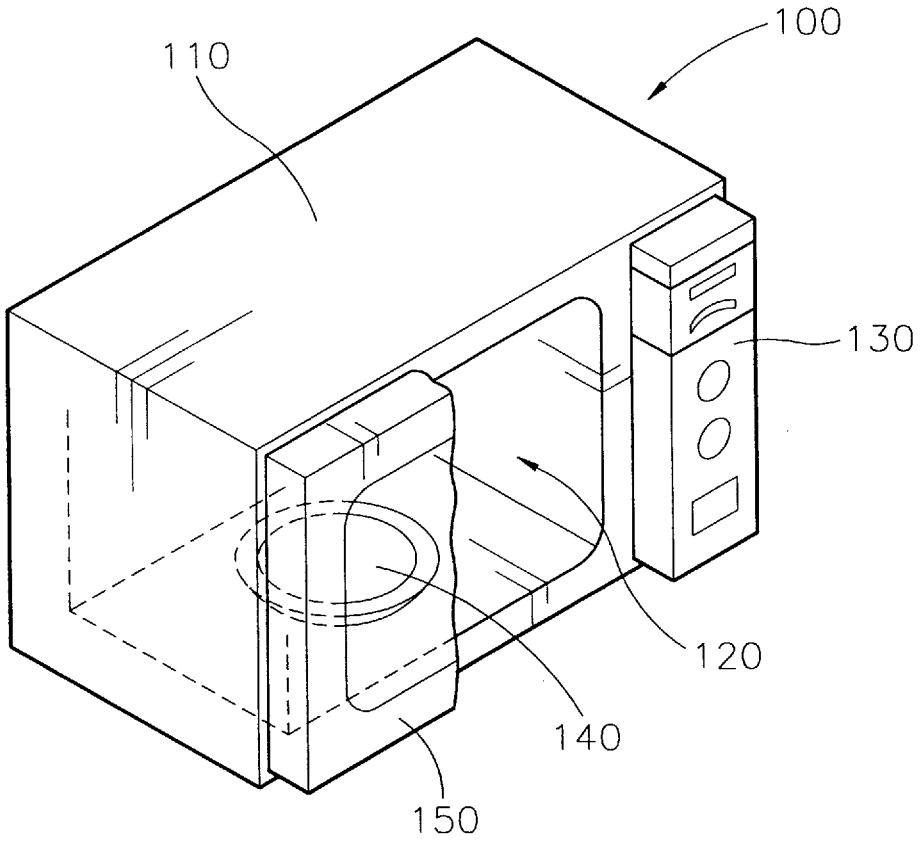
FIG. 1 (PRIOR ART)
FIG. 1 is a perspective view showing a conventional microwave oven.
Figure 2:
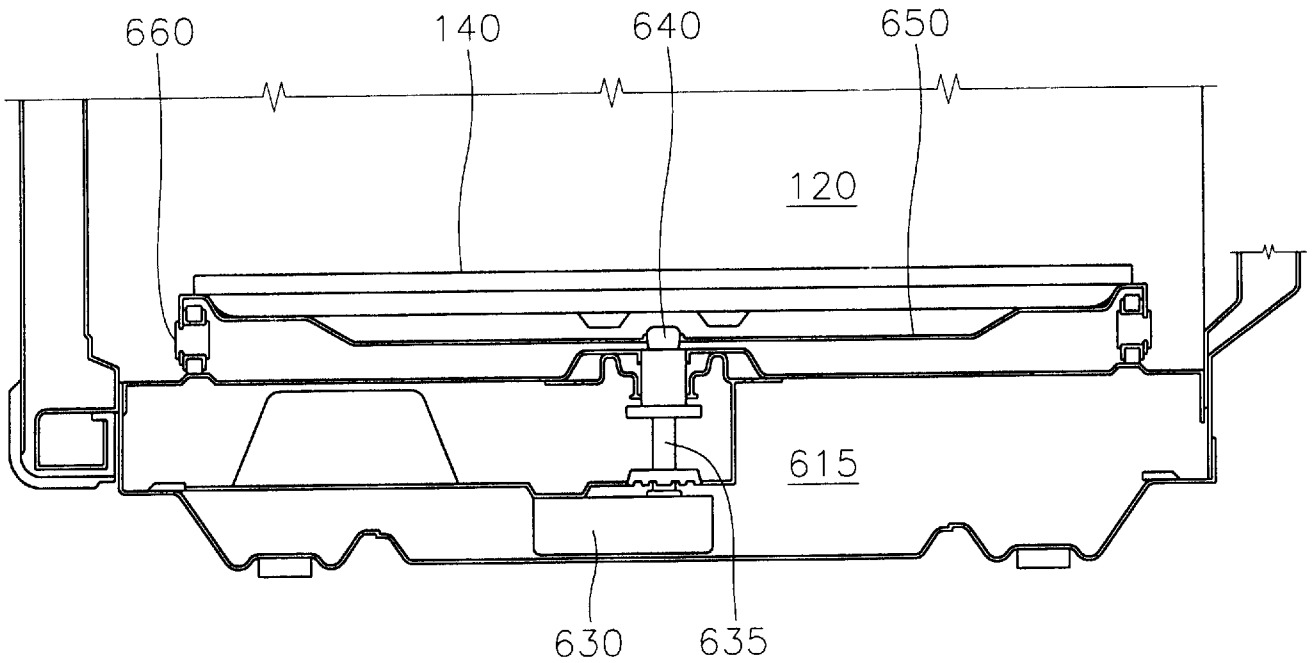
FIG. 2 (PRIOR ART)
FIG. 2 is a cross-sectional view showing an inner structure of a conventional microwave oven.
Figure 3:
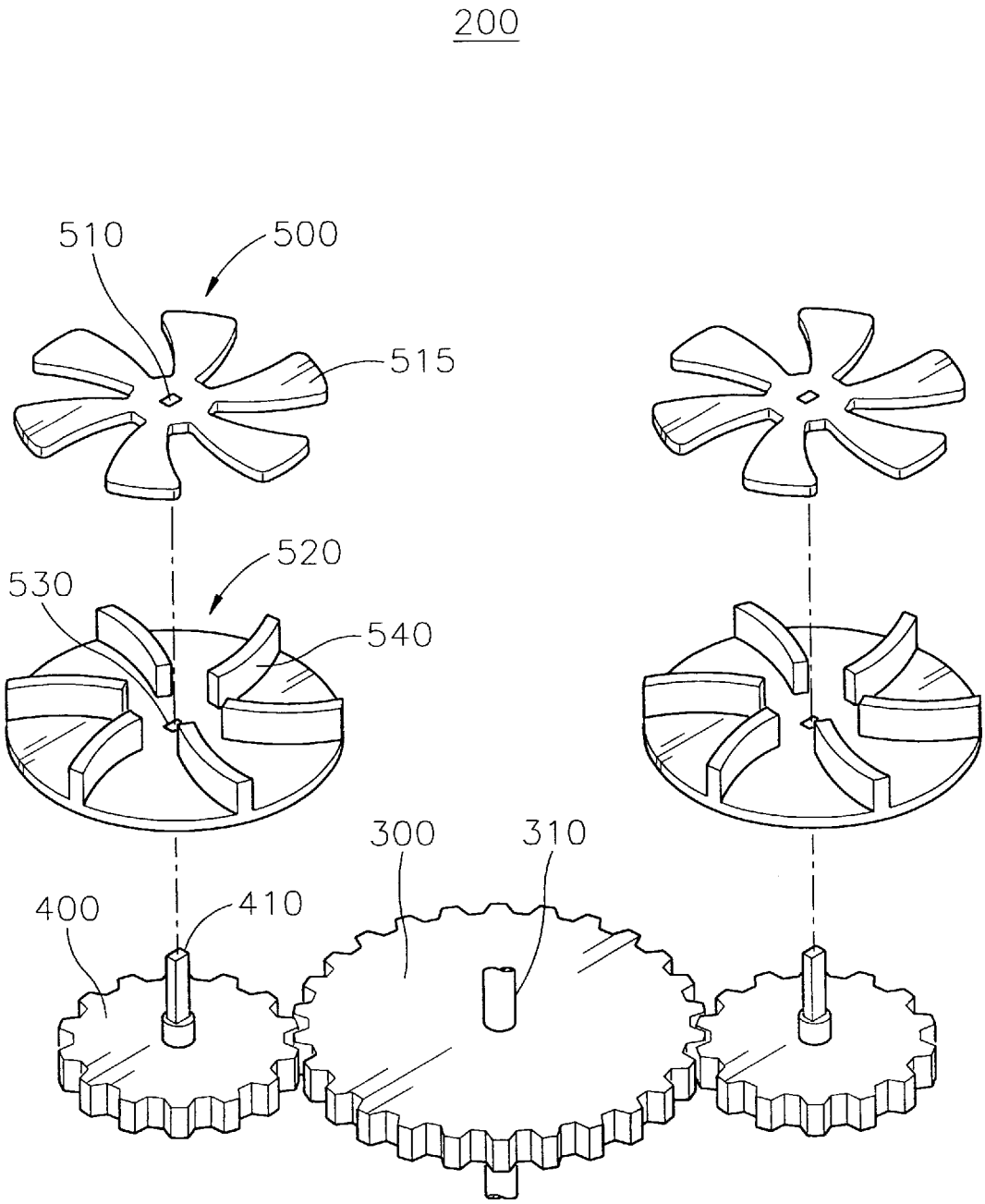
FIG. 3 is an exploded perspective view showing a microwave oven equipped with a microwave stirrer according to the present invention.

Hereinafter, microwave stirrer 200 according to the present invention will be described with reference to FIG. 3.

A main gear 300 is fixedly inserted around a predetermined position of rotating shaft 310 and is engaged with two secondary gears 400. Each of secondary gears 400 is integrally formed at a center position thereof with a shaft 410 extending vertically therethrough. Fans 520 are fixedly inserted around respective predetermined positions of shafts 410. Shafts 410 are rotatably supported at screen 755 and a bottom wall of recess 715.

Stirring plates 500, which are made from a microwave-reflective material, are mounted on fans 520. Preferably, stirring plates 500 are made from a metal which has a high reflectivity with respect to a microwave, such as aluminum, and are formed as fan-shaped plates having six wings 515. Fans 520 are formed at top surfaces thereof with six guide vanes 540, which have a shape corresponding to a shape of wings 515 and serve to stably rotate stirring plates 500. Stirring plates 500 and fans 520 are formed at respective center positions thereof with holes 510 and 530 such that shafts 410 are fixedly inserted through holes 510 and 530 so as to simultaneously rotate stirring plates 500 and fans 520 as motor 730 is actuated.

Secondary gears 400 have a size smaller than that of main gear 300 such that secondary gears 400 have a higher RPM than that of main, gear 300 in order to improve the stirring efficiency, thereby uniformly distributing the microwave energy into chamber 710.

Hereinafter, the operation of the microwave oven according to the present invention will be explained.

When microwave oven 700 is operated, a microwave generated by magnetron 705 is radiated into chamber 710 by means of antenna 706, and motor 730 is actuated. Subsequently, main gear 300 assembled to rotating shaft 310 is rotated, fans 520, and stirring plate 500 mounted on two secondary gears 400 are rotated. Stirring plates 500 reflect the microwave so that the microwave is uniformly dispersed into chamber 710. Meanwhile, by the rotation of rotating shaft 310, tray 750 coupled to rotating shaft 310 is rotated, and subsequently, dish plate 720 placed on the top surface of tray 750 is rotated. All of the above operations occur simultaneously, thereby uniformly heating the foodstuff.

As described above, the microwave oven equipped with a microwave stirrer according to the embodiment of the present invention can simultaneously drive dish plate 720, on which a foodstuff to be heated is placed, and microwave stirrer 200.

Furthermore, the microwave oven equipped with a microwave stirrer can facilitate the random reflection of the microwave so that the microwave is uniformly dispersed into chamber 710, thereby uniformly heating the foodstuff.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A microwave oven having wall sections forming therein a chamber at a side portion of which a magnetron and an antenna for generating and radiating a microwave is installed and at a lower portion of which a tray for rotatable supporting a foodstuff thereon isinstalled, the microwave oven comprising:

a mode stirrer for stirring the radiated microwave and uniformly dispersing the microwave in the chamber, the mode stirrer being installed beneath the tray and including a plurality of first gears, shafts vertically extending from the first gears, fans disposed around the shafts and formed at upper surfaces thereof with a plurality of radially extending guide vanes, and stirring plates made of a microwave-reflective material, disposed on the fans and fan-shaped with a plurality of wings corresponding to the guide vanes of the fans, the fans supporting the stirring plates so as to minimizing deformations of the stirring plates; and a driving structure for simultaneously driving both the tray and the mode stirrer, the driving structure including a motor mounted at a bottom wall of the wall sections, a rotating shaft which extends upwardly from the motor so as to be coupled to the tray, and a second gear fixedly disposed around the rotating shaft, the first gears being engaged with the second gear along a circumference of the second gear.

2. The microwave oven according to claim 1, wherein three rollers for allowing the tray to stably rotate are mounted at a circumferential portion of a bottom surface of the tray at intervals of 120 degrees, and a dish plate on which the foodstuff is placed is placed on a top surface of the tray.

3. The microwave oven according to claim 1, wherein the stirring plates are made of aluminum.

4. The microwave oven according to claim 1, wherein the plurality of first gears are two first gears.

5. The microwave oven according to claim 1, wherein the fans have six guide vanes, each fan having a first shape corresponding to a second shape of each stirring plate.

6. The microwave oven according to claim 1, wherein the mode stirrer is installed in a recess formed at a bottom wall of the chamber.

7. The microwave oven according to claim 6, wherein a microwave-permeable protective screen is mounted on an upper portion of the recess, the screen being formed at a center portion thereof with a hole which is positioned in correspondence to a position of the rotating shaft, thereby permitting the rotating shaft to pass therethrough.

8. The microwave oven according to claim 7, wherein the shafts are rotatably supported by the screen and a bottom wall of the recess.

9. The microwave oven according to claim 1, wherein the first gears have a size smaller than a size of the second gear so that the first gears have a larger RPM than an RPM of the second gear.

* * * * *